United States Patent [19]

Colombo et al.

[11] 4,174,293

[45] Nov. 13, 1979

[54] PROCESS FOR DISPOSAL OF AQUEOUS SOLUTIONS CONTAINING RADIOACTIVE ISOTOPES

[75] Inventors: Peter Colombo, Patchogue; Robert M. Neilson, Jr., Setauket; Walter W. Becker, Shoreham, all of N.Y.

[73] Assignee: The United States of America as represented by the United States Department of Energy, Washington, D.C.

[21] Appl. No.: 841,410

[22] Filed: Oct. 12, 1977

[51] Int. Cl.[2] ..... G21F 9/20

[52] U.S. Cl. ..... 252/301.1 W; 264/0.5

[58] Field of Search ..... 252/301.1 W; 250/506, 250/507; 264/0.5

[56] References Cited

U.S. PATENT DOCUMENTS 3,012,385 12/1961 Hufft ..... 252/301.1 W

FOREIGN PATENT DOCUMENTS 1199414 8/1965 Fed. Rep. of Germany ... 252/301.1 W 938211 10/1963 United Kingdom ..... 252/301.1 W

OTHER PUBLICATIONS

Perry, J. H., Ed., *Chemical Engineers' Handbook*, McGraw-Hill Book Co., N.Y., 1950, pp. 1152-1153.

Stecher, P. G. et al., Eds., *The Merck Index*, Merck & Co., Inc., Rahway, N.J., 1968, p. 115.

*Primary Examiner*—Benjamin R. Padgett

*Assistant Examiner*—Deborah L. Kyle

*Attorney, Agent, or Firm*—Dean E. Carlson; Leonard Belkin

[57] ABSTRACT

A process for disposing of radioactive aqueous waste solutions whereby the waste solution is utilized as the water of hydration to hydrate densified powdered portland cement in a leakproof container; said waste solution being dispersed without mechanical inter-mixing in situ in said bulk cement, thereafter the hydrated cement body is impregnated with a mixture of a monomer and polymerization catalyst to form polymer throughout the cement body. The entire process being carried out while maintaining the temperature of the components during the process at a temperature below 99° C. The container containing the solid polymer-impregnated body is thereafter stored at a radioactive waste storage dump such as an underground storage dump.

7 Claims, 3 Drawing Figures

HEAT OF HYDRATION FOR VARIOUS TYPES OF CEMENT

PROCESS FOR DISPOSAL OF AQUEOUS SOLUTIONS CONTAINING RADIOACTIVE ISOTOPES

BACKGROUND OF THE INVENTION

The invention described herein was made in the course of, or under, a contract with the United States Energy Research and Development Administration.

In recent years there has been a large scale increase in the number of water-cooled nuclear reactors both in the United States and abroad. This has created a large problem in that such reactors create large quantities of radioactive solutions of aqueous wastes. The water molecules contained in such wastes often contain the element tritium which in and of itself poses environmental hazards. Further, such aqueous waste solutions may contain radioactive isotopes of elements such as cesium, iodine, and the like, which have relatively low vaporization temperatures. Safety requires that such wastes be stored in leak-proof containers over long periods of time to prevent damage to the environment.

Due to the large volume of such wastes, disposal methods must be economical if nuclear power is to survive in competition with fossil fuel plants.

In British Pat. No. 938,211, issued to Rudolph Albert on Oct.2, 1963, entitled "Improvements in Methods of Solidifying Watery Atomic Waste", there is disclosed a process whereby aqueous solutions of atomic waste waters are used as the water, for the hydration of a mixture of alumina cement with or without aggregate added thereto; the water-cement mixture is thereafter allowed to set up, and is later baked at a temperature of about 1200° C. for several hours, allowed to cool and thereafter impregnated with plastics, paraffin and/or other materials to reduce the possibility of the radioactive wastes entrained therein from leaking out. The temperatures employed in this process boils off excess water from the concrete mixture and will cause many of the radioactive elements contained therein to vaporize, thus requiring apparatus to prevent such vapors from reaching the atmosphere. This thermal requirement greatly increases the cost of the process and reduces the production rate of the plant.

It is an object of this invention to provide an efficient, economical process for incorporating aqueous solutions containing radioactive elements at temperatures below 99° C., into a solid substantially non-compressible, non-leachable body.

SUMMARY OF THE INVENTION

A process for disposing of aqueous solutions containing radioactive wastes whereby the waste solution is dispersed in situ throughout a mass of powdered portland cement, said cement being placed in a leak-proof container and is densified tnerein to a bulk density ranging from about 1.3 to about 1.8 grams per cubic centimeter and a practice size ranging from about 120 mesh to about 400 mesh; the amount of water dispersed in the powdered cement being in a weight ratio thereto of from about 15 weight percent to about 30 weight percent based upon the weight of the powdered cement so used; sealing the container containing the cement with the aqueous solution dispersed therein to prevent evaporation of the aqueous solution contained therein during cement curing, thereafter impregnating the cured cement in said container with a mixture of a monomer and polymerization catalyst and polymerizing the monomer impregnated in said mixture in situ within the cured cement body, thereafter storing the container containing the polymer-impregnated cement in a storage facility suitable for storing such containers. Throughout the process the temperature of the cement body containing the aqueous solution containing the radioactive waste material is maintained at a temperature below 99° C. In the preferred embodiment of this invention, we maintain the cement-aqueous solution mix at a temperature below 90° C. throughout the processing.

While cooling mechanisms can be employed if it is desired to make very large bodies of cement in accordance with this process, none are needed when the body is formed within conventional 55 gallon industrial drums and type II portland cement is used. No mixing apparatus is required to work the mixture of cement and aqueous solution but rather the water is dispersed in situ within a quiescent body of the densified powdered cement in the container through porous tubes strategically placed throughout the powdered cement. These tubes may be left in the cement after processing.

The impregnation of the concrete with monomer and catalyst is accomplished simply by covering the entire surface of the cured cement within the container with a mixture of monomer and polymerization catalyst and allowing the monomer-catalyst solution to seep down thru and completely impregnate the concrete body in the container.

DESCRIPTION OF THE PREFERRED EMBODIMENT

Figure 2:
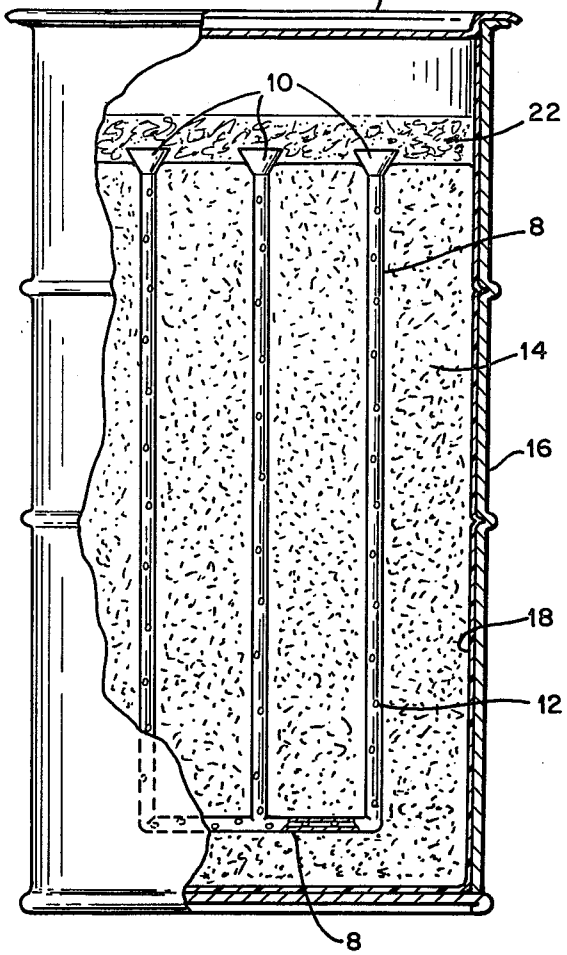
FIG. 2 shows diagrammatically a cross-section of a commercial drum having a plastic liner, lid and porous tubes entrained in cement which is inside the plastic liner.
Figure 1:
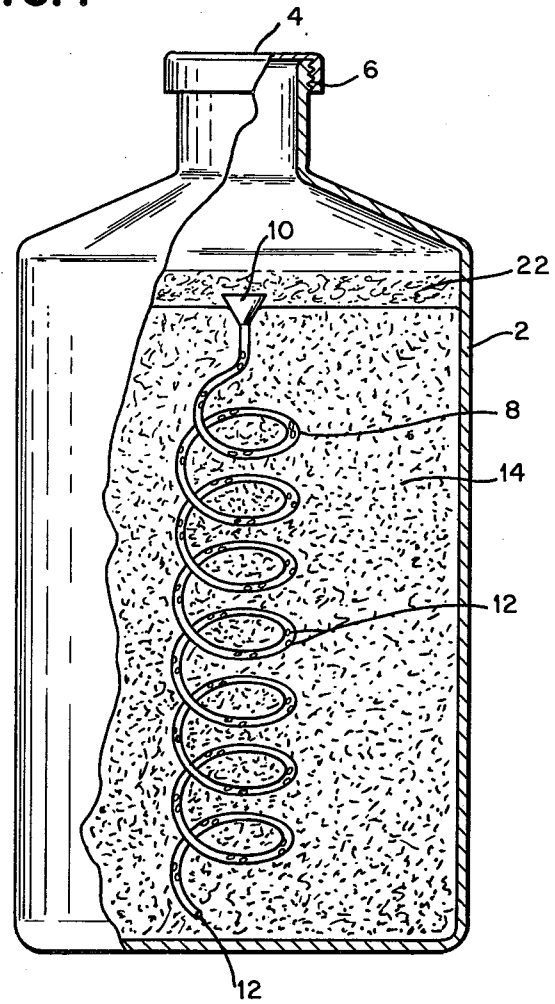
FIG. 1 shows diagrammatically a central vertical section of our apparatus in the form of a container having a screw-type lid for use as a container in the practice of our invention.

To carry out the process disclosed in this invention a molded seamless container 2 as shown in FIG. 1 hereof or a commercial steel drum 16, having a leak-proof plastic liner 18 as shown in FIG. 2 having funnels 10 connected to tubes 8 having holes 12 suspended in the container, is free flow filled with dry portland cement having a particle size ranging from 120 to 400 mesh. The dry powdered cement is densified in the container by mechanical agitation of the powder in the container by means such as vibrating the container, tamping the powder down, and the like, until the powdered cement in the container has a bulk density ranging from about 1.3 to about 1.8 grams per cubic centimeter. Care should be taken to avoid getting significant amounts of cement in the tubes and/or funnel and the level of the dry cement should be mainained below the wide lip of the funnel.

The aqueous solution containing the radioactive wastes therein is then dispersed in situ within the densified cement by pouring it into the funnels 10 and allowing it to be carried by tubes 8 thru porous openings 12 throughout the body of the cement 14. The amount of aqueous solution that can be dispersed in the densified powdered portland cement ranges from about 15 weight percent to about 30 weight percent, based upon the weight of the powdered portland cement in the container. Thereafter the container is sealed off from the atmosphere and the water-cement mixture is left in a quiescent state and allowed to set and cure to form a free standing monolith using the aqueous solution containing the radioactive waste to provide the water of hydration to form a solid cement body.

To seal the container a screw-type cap 4 with threads 6 as shown in FIG. 1 or a compression-type lid 20 as shown in FIG. 2 can be employed. This step of sealing the water-cement mixture during the curing step provides several benefits, first it prevents the release of tritium containing water during the curing step, secondly it allows the container to be placed in relatively low-cost storage facilities during curing, and thirdly it permits accurate quality control during processing since it prevents atmospheric humidity from having an effect during this stage of the processing.

When curing of the water-cement mixture is completed, the containers are unsealed and a solution of monomer with polymerization catalyst dissolved therein is introduced upon the upper surface of the cured cement in an amount sufficient to provide both for complete impregnation of the cement by the monomer-catalyst solution and for a layer of the monomer-catalyst solution to be formed fully covering the upper surface of the cured concrete in the container. The container is again resealed in the preferred embodiment of our invention to prevent evaporation of the monomer and the container is then stored in a quiescent place until the monomer has polymerized into a solid polymer. Thereafter the container can be shipped to a permanent disposal area such as an underground storage dump. The layer of solid polymer on top of the cement provides a safety seal in the event of container seal leakage or accidental opening of the lid.

Throughout the entire processing, care must be taken to ensure that the cement containing the radioactive wastes entrained therein is maintained at a temperature below 99° C. and preferentially maintained at a temperature below 90° C. This temperature limit is required to prevent the vaporization and escape of low-boiling point radioactive wastes such as water molecules containing tritium isotopes. The term mesh sizes as used in this invention refers to U.S. Standard sieve sizes and is well known to those skilled in the art.

Since the curing of the cement accomplished by the cement particles being hydrated by the water molecules contained in the aqueous solution containing the radioactive wastes is an exothermic reaction, care must be taken to provide sufficient means for cooling if large blocks of cement are to be formed in the practice of our invention. The cooling can be accomplished by mechanical cooling such as maintaining the blocks in a cool temperature. Preferentially, we recommend that geometric-sized and shaped containers be employed that will prevent the material in the container from overheating when the containers containing such materials are kept at room temperature.

Precaution must be taken to ensure that the radiation inherent in the aqueous solutions containing radioactive wastes does not in itself raise the temperature of the product both during and after processing. In general we have found that aqueous solutions having a heat production rate of one watt per liter can be easily handled by our process provided that the mass of concrete has at least one dimension of about one foot when processing is carried out with the exterior container being in an atmosphere having a temperature ranging from 10° C. to 40° C.

In general, any liquid monomer having a viscosity such that it can completely penetrate the cement concrete matrix without the need for vacuum and/or pressure and which can be polymerized in situ by heat, chemicals or radiation is preferred although not essential to this process.

Impregnation of the cured concrete at atmospheric pressure and at ambient temperature has been demonstrated using addition type vinyl homomonomers and comonomers (mixture of homomonomers) in varying proportions containing a chemical initiator with or without a promoter for the purpose of initiating the polymerization reaction.

Some of the monomer systems which have been used successfully to demonstrate this process are:

| Monomer[a] | Initiator[c] | Promoter |
|---|---|---|
| Styrene | benzoyl peroxide | heat |
| methyl methacrylate | " | " |
| 90% styrene-10% TMPTMA[b] | benzoyl peroxide | dimethyl aniline |
| 60% styrene-40% acrylonitrile | " | heat |
| vinyl ester DOW470 | methyl ethyl ketone peroxide (MEKP) | cobalt napthenate |

[a]Comonomers can be used in varying proportions although those indicated above gave excellent results
[b]trimethylolpropanetrimethyacrylate
[c]any initiator capable of initiating free radical polymerization can be used.

The impregnation of cement castings with solutions of monomers and catalysts is well known to those skilled in the art.

The choice of monomer and polymerization catalyst and the amount thereof to be used in the practice of our invention will of course be dependent upon the porosity of the cured cement to be impregnated and the rate at which polymerization is desired. In general we favor the use of slow acting polymerization catalysts in the practice of our invention.

However any polymerization catalyst can be successfully employed provided that the quantity employed does not cause the monomer to polymerize too rapidly or prevents complete impregnation of the cured cement in the container.

A novel and beneficial use of our process is in the formation of radiation devices. When our process is utilized to make such devices, the porous tubes used to disperse the aqueous solution in situ within the powdered portland cement can act as reinforcing rods and the container can be shaped to optimize the desired radiation effects for the radiation process which the device is intended. Thus a tubular shaped radiation device can easily be produced using the process disclosed in this invention, i.e., a pipe section for the irradiation of liquids being passed therethrough can be prepared using this invention.

In general there are five main types of portland cement useable in our invention, the compositions of which are given in the following chart:

COMPOUND COMPOSITION OF PORTLAND CEMENT

| Type of cement | Compound composition, percentage 1 | 2 | 3 | 4 | $CaSO_4$ | Free CaO | MgO | Ignition loss |
|---|---|---|---|---|---|---|---|---|
| Type I | 49 | 25 | 12 | 8 | 2.9 | 0.8 | 2.4 | 1.2 |
| Type II | 46 | 29 | 6 | 12 | 2.8 | 0.6 | 3.0 | 1.0 |
| Type III | 56 | 15 | 12 | 8 | 3.9 | 1.3 | 2.6 | 1.9 |
| Type IV | 30 | 46 | 5 | 13 | 2.9 | 0.3 | 2.7 | 1.0 |
| Type V | 43 | 34 | 4 | 12 | 2.7 | 0.4 | 1.6 | 1.0 |

Figure 3:
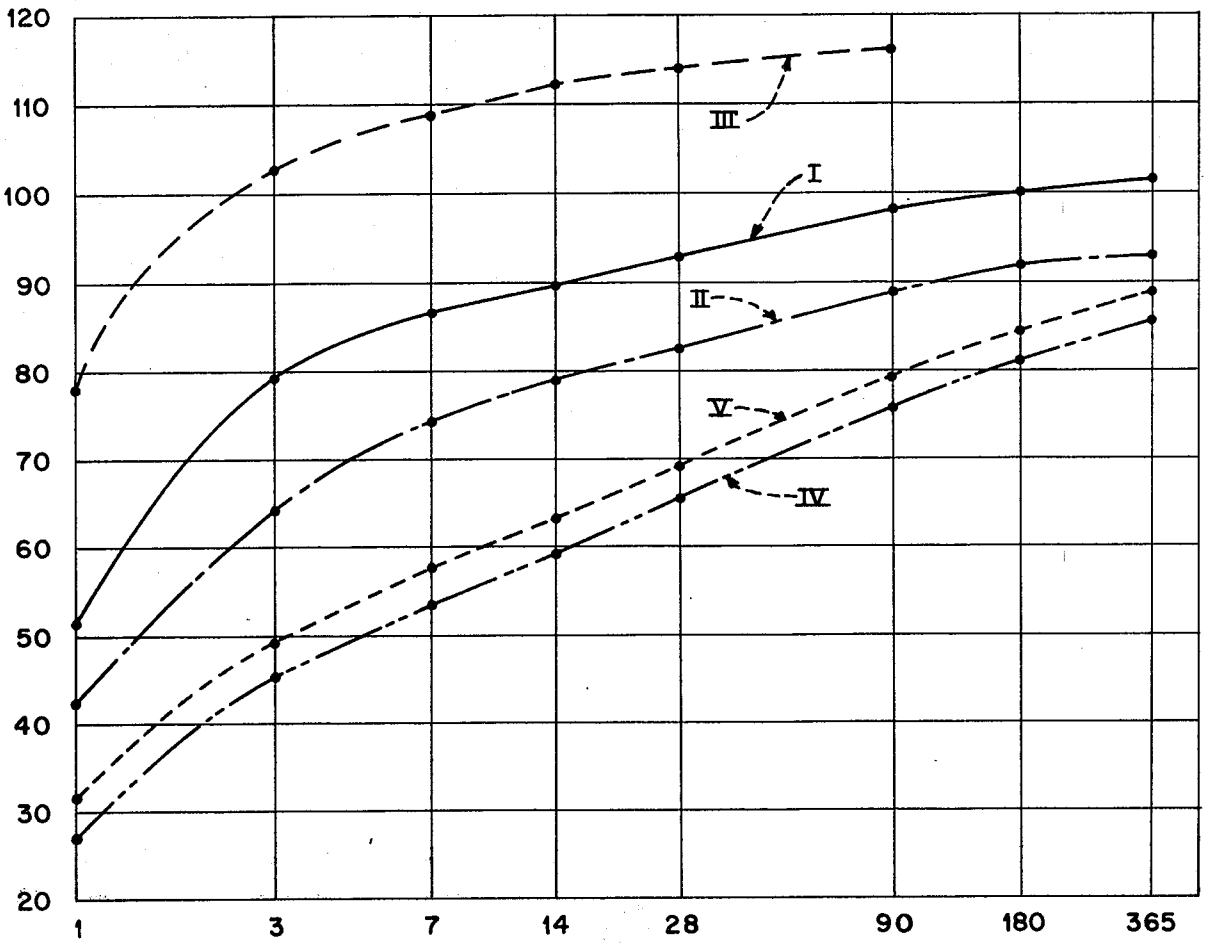
FIG. 3 is a graph plotting the heat of hydration given in calories per gram of five types of portland cement against age in days of curing of the cement.

1—$3CaO \cdot SiO_3$
2—$2CaO \cdot SiO_2$
3—$3CaO \cdot Al_2O_3$
4—$4CaO \cdot Al_2O_3Fe_2O_3$ In the preferred embodiment of our invention we use type II portland cement. FIG. 3 (Page 49 of handbook) shows the heat of hydration given in calories per gram of cement for each of the five types of portland cement. From this, one skilled in the art can readily calculate both amounts and dimensions of the shape of bodies formable in the practise of our invention which are compatible with the thermodynamic requirements of this invention.

A very significant advantage gained when our invention is employed and the cement is densified prior to the addition of the aqueous solution containing the radioactive waste material is a substantial reduction in the bulk volume of the end product which must be stored. Further, it greatly lessens the chances of channeling in the product which can produce localized radioactive hot spots in the final product which are very undesirable from both a thermodynamic and lixiviation standpoint. These and other advantages will be readily recognized by those skilled in the art.

Portland cement found useable in this invention is made by intimately intergrinding a properly proportioned mixture of argillaceous (containing alumina and silica) and calcareous (containing lime) materials, which mixture is burned until it approaches fusion. The resulting clinker, when pulverized with 2½ to 5 percent of gypsum ($CaSO_42H_2O$), forms a product which does not slake and which possesses the property of combining chemically with water and hardening in its presence. Some types of cement may require small quantities of iron ore or siliceous materials in their manufacture.

For practical purposes, portland cement may be considered as being composed of four principal compounds, the approximate percentages of which can be calculated from the chemical analysis. In addition to these major compounds, small amounts of calcium sulfate, magnesium oxide, alkalies, and other materials are present. While from a purely technical standpoint the validity of assuming the quantitative distribution of the major compounds in cement is subject to question, their utility in correlating cement properties is of real value. The major compounds with their chemical formulas and accepted abbreviations are as follows:

| | |
|---|---|
| Tricalcium silicate | $3\ CaO \cdot SiO_3$ |
| Dicalciium silicate | $2\ CaO \cdot SiO_2$ |
| Tricalcium silicate | $3\ CaO \cdot Al_2O_3$ |
| Tetracalcium alumino-ferrite | $4\ CaO \cdot Al_2O_3Fe_2O_3$ |

The following example is given to illustrate a practice of a preferred embodiment of our invention. A cylindrical glass battery jar with a diameter of 11½ inches and a height of 24 inches was filled to a height of 20 inches with dry portland type III cement having a fineness (as measured by air-permeability testing) of 2,800 $cm^2/g$. with less than 3 weight percent greater than 170 mesh. This required 43.6 kilograms of cement.

The cement was vibrated in its container with a Syntron Vibra-Flow Model V51 vibrator at a Controller setting of 5 for a period of five minutes to densify. The height of the concrete in the container after vibration was 17 inches, reflecting an increase in density of from 1.28 $gram/cm^3$ to 1.51 $gram/cm^3$.

A glass injector tube was inserted along the centerline of the cement cylindrical axis to a depth of 10 inches. The injector was a ½ inch diameter×12 inch long glass tube containing twelve injector ports. The ports were located in groups of four at three levels along the injector length. In each group, ports were located 90° from one another about the axis of the injector. Taking the bottom of the injector as x equals 0, the port groups were located at x equals 0.5 inches, 5 inches, and 9.5 inches. Injector hole size was increased towards the top of the injector such that the hydraulic head was equal for all ports. A chromelalumel thermocouple was inserted into the cement near the injector for thermal measurements of cement during curing and polymerization exotherms.

Tritiated aqueous waste was added through the injector to produce a water to cement ratio of about 0.25 by weight. This required 10.9 kilograms of water and gave a loading of 10.7 liters of waste per cubic foot of concrete. The waste was added at a rate of 15 liters per hour.

The cement casting was allowed to cure at 70° F. for twenty-four hours. The peak temperature of the concrete casting was 70° C.

Styrene monomer to which ½ weight percent A1BN (2,2 Azobis-(2-methylpropionitrile)) was added as a polymerization catalyst was added to the top of the cement casting and allowed to soak in. Monomer was also added to fill the injector tube. The monomer was allowed to soak for approximately 4 hours, after which time, it was observed that no additional monomer was soaking in. The excess monomer was siphoned off the top of the casting.

The casting was heated to 50° C. for 16 hours in order to polymerize the monomer. The peak casting temperature as indicated by the thermocouple was 75° C. The resultant increase in casting weight due to polymer was 7.2 kilograms, corresponding to a polymer loading of 13 weight percent in the cement casting. There was thin film of polymer on the top of the casting.

A second experiment was carried out wherein high alumina cement was substituted for the portland cement in the above experiment. A thermocouple placed in the center of the sample indicated a peak temperature of 186° C., approximately 8 hours after the water was dispersed in the cement. Substantial water was observed to be boiling off from the sample at that time.

The working example describes the injector tube used for a 11½ inch diameter×17 inch high casting. The following are considerations relative to injector design and placement for various casting sizes.

For a cylindrical casting, the injector is placed along the cylinder axis such that the distance of the lower end of the injector from the casting bottom (x) is equal to or slightly greater than the casting radius (r). This assumes a hole is located at or near the lower end of the injector and the casting height is greater than or equal to 2 r. Water is translated radially by capillary action and cement absorption. In addition to these factors, downward motion is also aided by gravity. Since it is desirable for water to reach the casting sides and bottom at the same approximate time, the lowest injector hole should not be closer to the casting bottom than it is to the casting sides. Capillary action and absorption also give rise to an upward component of motion, but since this is opposed by gravity, the uppermost injector hole should be located closer to the surface of the casting than the sides. We suggest that the distance of the uppermost injector hole from the casting surface (y) be approximately ½ the casting radius assuming that the casting height h is greater than or equal to the casting diameter. These considerations also apply to a rectangular prism although the waste loading/ft$^3$ will probably be somewhat lower due to difficulties in introducing waste into corners before surface break through occurs.

Water must be introduced slowly into the cement to avoid channeling and oversaturation. Water passsage through an injector hole is proportioned to the hole size and hydrostatic head in the injector tube at the hole. We have tended to keep the hydrostatic head at the uppermost injector hole below two feet. The additional hydrostatic head at the lower injector hole is dependent upon the length of the injector. For a 55 gallon drum size, the injector length is approximately 2 feet and the maximum hole size recommended would be about ⅛" in diameter. For very long injectors or high hydrostatic head, a smaller hole size might be required. This would be determined by observation of channeling for waste injection under anticipated conditions. If the hydrostatic head due to the length of the injector is equal or greater than the imposed head above the injector, water flow rates should be equalized by decreasing the hole area towards the bottom of the injector in proportion with the increase in hydrostatic head.

Porous metal frit materials might be quite useful for waste injection because of the small controllable hole size and large number and even distribution of holes. As yet we have not tried this. Thus the size of the injector holes should be done in accordance with the principles stated above.

Porous metal frit injectors can be used in the practice of this invention. In other injectors, the holes should be located no further apart along the injector length than the radius of the casting. Closer placement is preferable. Also, injectors should be located at 90° or less from one another about the axis of the injector. Each orientation about the injector axis should be spaced no further apart than the casting radius. A hole at the bottom of the injector is not recommended since insertion in the dry cement may possibly plug up the hole. All holes are preferentially located on the sides of the injector with the lowermost holes close to the end of the tube.

The injector can be made of metal, plastic and/or glass. Material of preference may depend upon whether the injector is removed and reused or left in the casting during impregnation and disposal.

What is claimed is:

1. A process for the disposal of aqueous solutions containing radioactive waste material comprising;

(a) densifying dry particulate portland cement in a sealable leak-proof container to a bulk density ranging from about 1.3 to about 1.8 grams per cubic centimeter, said cement having a particle size ranging from about 120 mesh to about 400 mesh;

(b) dispersing without mechanical agitation from about 15 weight percent to about 30 weight percent of the aqueous solution based upon the weight of the densified cement in-situ within the densified cement;

(c) sealing said densified cement containing said aqueous solution off from the atmosphere until the said aqueous solution is hydrated with said cement;

(d) impregnating the hydrated cement with a mixture of monomer and a polymerization catalyst and polymerizing the monomer in-situ within the pregnant hydrated cement;

(e) storing said pregnant hydrated cement in a suitable storage area;

(f) maintaining the temperature of the materials utilized in the process at a temperature below 99° C. throughout steps a thru e of the process.

2. The process of claim 1 wherein type III portland cement is used.

3. The process of claim 2 wherein the temperature of the materials utilized in the process are maintained at a temperature below 90° C. throughout steps a through e of the process.

4. The process of claim 3 wherein said monomer is styrene.

5. The process of claim 4 wherein the polymerization catalyst is 2,2 Azobis-2-methylpropionitrile.

6. The process of claim 5 wherein a safety seal of solid polystyrene is formed on the surface of said pregnant hydrated cement.

7. The process of claim 6 wherein the leak-proof container is a 55 gallon drum having leak-proof plastic liner.

* * * * *